United States Patent [19]

Gorkiewicz

[11] 4,111,506

[45] Sep. 5, 1978

[54] TILTING HANGER APPARATUS

[76] Inventor: Mitchell F. Gorkiewicz, 619 E. 6th St., Royal Oak, Mich. 48067

[21] Appl. No.: 812,175

[22] Filed: Jul. 1, 1977

[51] Int. Cl.[2] ..... A47B 81/00

[52] U.S. Cl. ..... 312/211; 312/212; 312/294; 248/95; 312/194

[58] Field of Search ..... 312/212, 294, 194, 302, 312/211, 307; 248/95, 99

[56] References Cited

U.S. PATENT DOCUMENTS

| | | | |
|---|---|---|---|
| 603,856 | 5/1898 | Mower | 312/294 |
| 677,634 | 7/1901 | Busselle | 312/194 |
| 883,477 | 3/1908 | Parr | 248/95 |
| 1,056,166 | 3/1913 | Gillespie | 312/294 |
| 1,568,356 | 1/1926 | Vumbaca | 312/194 |
| 2,420,015 | 5/1947 | Salsman et al. | 312/294 |
| 3,175,793 | 3/1965 | Kennedy | 248/99 |
| 3,387,905 | 6/1968 | Lindenschmidt et al. | 312/294 |
| 3,922,046 | 11/1975 | Schneider | 312/211 |

*Primary Examiner*—Mervin Stein
*Assistant Examiner*—Victor N. Sakran
*Attorney, Agent, or Firm*—William T. Sevald

[57] ABSTRACT

A rail is tiltably mounted on a crank arm at one end of the rail or the rail is hung at both ends on pivotal link hangers. In the case of the crank arm, the rail extends from the attached end over center to the opposite side of the crank arm so that when the crank rises or lowers with the attached end of the rail, the other cantilevered end of the rail lowers or rises in the opposite direction to tilt the rail. In the case of the pivotal link hangers, the distance between the pivot points at the hangers is greater than the distance between their connection to the rail so that when one link extends downwardly to lower that end of the rail, the other link extends outwardly to raise the other end of the rail to cause the rail to tilt. A trolley rolls on the rail and supports a container, such as a wastebasket. The apparatus may be mounted on a desk and a wastebasket may be carried by the trolley. By tilting the rail the trolley rolls to the lower end of the rail and carries the wastebasket with it. Operating linkage, stops, etc. are provided to bi-directionally activate the tilt and to prevent overtilt.

5 Claims, 8 Drawing Figures

TILTING HANGER APPARATUS

BACKGROUND OF THE INVENTION

Containers, such as wastebaskets, clothes hampers and storage bags, tool boxes, parts bins, etc., are used at intervals and at most other times are not used. They have relatively short periods of use and relatively long periods of non-use during which they occupy valuable space, and, instead of lending to efficiency, get in the way of things and people where they are not only idle but also impedimenta.

In the case of wastebaskets for example, they have periods of use such as when the main arrives and the envelopes and other unneeded material, such as unwanted advertisements, are thrown away. The stenographer or other office worker then uses the wastebasket at other isolated times to get rid of wastepaper, lunch bags, etc. The wastebasket usually sits on the floor. If it is put under a desk or table it is difficult to use. If it is left in the open, it is a clutter item, a blockade to movement, a hazard, and/or an item which displaces a thing which is more often used.

When the janitor comes in at night to clean the floor, the baskets must be picked up and put on the top of desks and tables, the floor cleaned and then they must be handled again and put down on the floor. After emptying them, they are dropped to the floor and usually are out of the desired position when the user comes in the next morning. Then they need to be re-located. Tool boxes, parts bins, etc. present the same problems in factories, stores, garages, service-stations, etc. Also other items and things entail like problems which the present invention solves such as deep closets and recesses where the apparatus will move to the back of the closet or recess for storage and will move forward for use.

SUMMARY OF THE PRESENT INVENTION

The space beneath work tables, desks, benches, etc. is only partially used if used at all. In the case of a desk or table, the person using it while sitting requires about 1 foot in depth and 2 feet in width for knee, calf and foot space. With a 36 inch wide desk or table, this leaves 2 feet in depth of unused space under the desk adjacent the opposite or far side of the desk. This space is difficult to utilize because it is low and recessed. It would be an ideal place to put the occasionally used wastebasket except that it would be difficult to use, to place, and to remove for emptying.

It is a primary object of the present invention to utilize this unused space under desks, tables, etc. for wastebaskets and other containers by providing hanger apparatus which carries the container into the unused space for storage or inactive periods and which carries the container out of the unused space for convenient use.

The hanger apparatus of the invention has a tiltable rail and a trolley. The container is rollably suspended on the rail by the trolley. When the rail is tilted downwardly-inwardly the trolley rolls along the rail to the far side of the desk or table carrying the container with it and remains there. When the rail is tilted downwardly-outwardly, the trolley rolls along the rail to the near side of the desk carrying the container with it and remains there for use. After it is used, the rails is tilted downwardly-inwardly and the trolley rolls to the far side of the desk carrying the container with it where it remains until it is needed again for use.

Thus the container is easily put in a use position and in a storage position and occupies previously unused space and leaves the space previously used by the container available for other use and clear of obstruction. In an office or factory where hundreds of containers are used, it means a saving of hundreds of square feet of space, makes more square feet of space available for other use, and clears hundreds of square feet of space of obstructions.

The invention also makes janitorial cleaning of the floor more efficient as the containers are hung above the floor leaving it clear for sweeping, vacuuming, washing and/or waxing. With the invention there is no need for the janitor to put all the wastebaskets on the desks and tables prior to floor cleaning and no need to then put them on the floor again after cleaning. Also the janitor knows where each container is, such as a wastebasket, for emptying. All the janitor has to do is to tilt the rail and the container rolls out to be emptied. He empties it and rolls it back into the storage position in a few seconds.

In one embodiment, the rails is mounted at one end of the rail on a crank-arm and the rail is cantilevered over center from its attached end to its extending end. Stops prevent overtilting in both directions. The stops may be the housing itself, be mounted on the housing, or incorporated in operating linkage.

In another embodiment, the rail is hung on pivotal hanger links at both ends of the rail with the distance between the connections to the rail being less than the distance between the points at which the links themselves are pivotally mounted. Thus when one link swings down to lower one end of the rail, the other end swings up to raise the other end of the rail so that the rail is tilted to roll the trolley.

In both embodiments the weight of the container and trolley maintains the position of the rail and trolley both in the storage and use positions as the rail is lowest at that point at the time. When the tilt of the rail is reversed, the trolley and container roll to the other end of the rail and stay in that position until the tilt of the rail is again reversed.

Convenient operating linkage is provided with both embodiments so that the user may swing a lever to roll the trolley and container into or out of the housing.

The rails preferably have upwardly curved ends so that when the trolley rolls to an end, it encounters a small rise decelerating the roll and preventing collision with the housing in one direction and with the user in the other direction. The up-turned ends also provide a steeper rise at either end of the rail so that when the tilt of the rail is reversed, the trolley is given an added impetus to roll in the desired direction thereby overcoming inertia, friction, etc. The rail may also have a curved conformation over its entire extent with similar effect.

The structure, operation and result of the apparatus of the invention will be more clearly understood from the detailed description of the illustrated embodiments hereinafter set forth and from the drawings now described.

DETAILED DESCRIPTION OF THE ILLUSTRATED EMBODIMENTS

Figure 1:
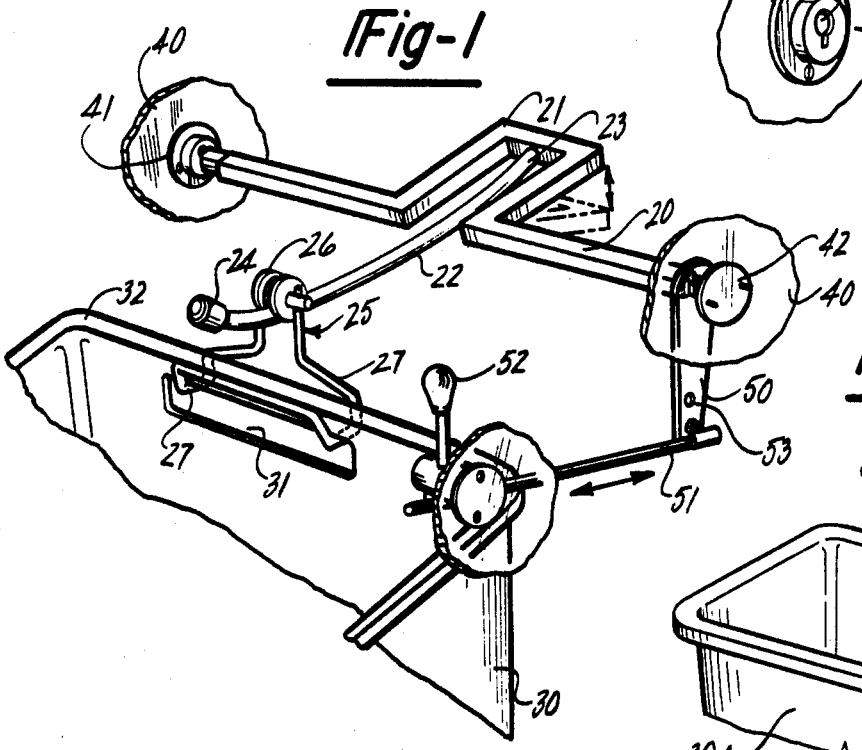
FIG. 1 is a perspective view of the pivotal shaft and crank arm embodiment of the invention showing the rail connection to the crank arm and cantilevered over center to an extending end, mounting means for the shaft and crank arm, operating linkage to swing the shaft and crank arm to tilt the rail, a removable trolley on the rail, and a container removably carried by the trolley, with parts broken away to save space.

Referring now to the drawings, wherein like reference numerals refer to like and corresponding parts throughout the several views, the novel TILTING HANGER APPARATUS for containers disclosed therein to illustrate the invention comprises a shaft 20, FIG. 1. A crank arm 21 is formed in the shaft 20. A rail 22 has an inner end 23 secured in the crank arm 21 and an outer cantilevered end 24. A trolley 25 has a wheel 26 riding on the rail 22 and a hanger 27 depending from the wheel 26. A container 30 has an opening 31 through which the hanger 27 enters and engages the side wall 32 of the container 30.

Figure 2:
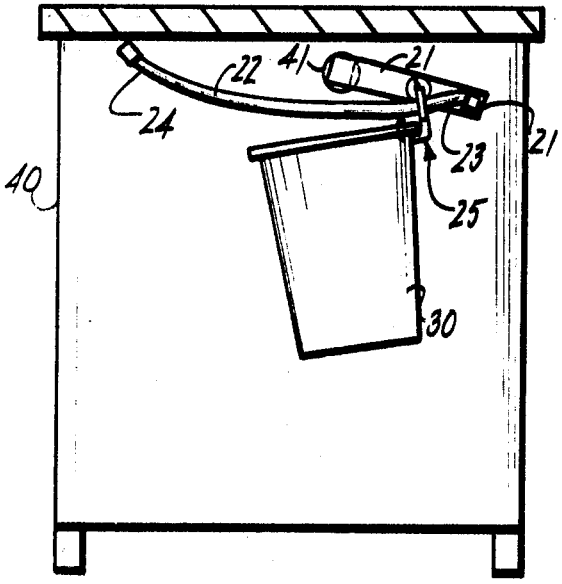
FIG. 2 is a side elevational view of a portion of the apparatus seen in FIG. 1 shown mounted on a desk, shown partly in cross-section, and illustrating the rail tilted to the storage position.

A disc 35 has a key-hole slot 36, FIGS. 1 and 2. Extensions 37 are nested in the ends of the shaft 20. A clamp 38 on the end of the shaft 20 forces the end of the shaft 20 into frictional engagement with the extension 37 to secure the adjusted position. A headed stud 39 extends from the extension 37 and fits in the key-hole slot 36 pivotally mounting the shaft 20. The discs 35 are secured to the housing 40 by screws 41 or pins 42. Since the headed studs 39 secure the extensions 37, only one clamp 38 is necessary to locate the crank arm 21 as desired but two may be used.

An arm 50 is angularly secured on the shaft 20 or on a shaft extension 37. A push-pull rod 51 is pivotally connected at one end to the arm 50. A control lever 52 is pivotally mounted on the housing 40. The rod 51 is pivotally connected at its other end to the control lever 52.

Movement of the control lever 52 in one direction pivots the shaft 20 to the position seen in FIG. 2 swinging the crank arm 21 downwardly lowering the inner end 23 of the rail 22 and raising the outer end 24 of the rail 22 to tilt the rail 22 downwardly-inwardly whereby the trolley 25 rolls down the rail 22 into the housing 40 carrying the container 30 into the housing to the storage position.

Figure 3:
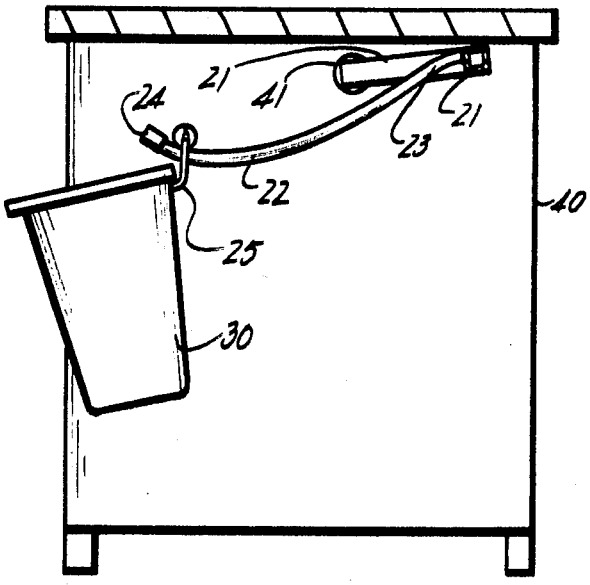
FIG. 3 is a view similar to FIG. 2 illustrating the rail tilted to the use position.

Movement of the control lever in the other direction pivots the shaft 20 to the position seen in FIG. 3, pivots the crank arm 21 upwardly elevating the inner end 23 of the rail 22 and lowering the outer end 24 of the rail 22 to tilt the rail 22 downwardly-inwardly whereby the trolley 25 rolls down the rail 22 out of the housing 40 to the use position.

It is to be noted that the control lever 52, push-pull rod 51 and lever 50 are interconnected at various points 53 on the arm 50 to provide various adjustments of mechanical advantage and speeds of operation of the tilting of the rail 22 to provide various speeds of trolley 25 travel along the rail 22 and for containers of various weight loads. The control lever 52 has spring pressed detent stops or other means to hold the control lever 52 in its opposite positions thereby locating the crank arm 21 in the use and storage positions.

Also, the linkage just mentioned may be deleted with the user tilting the rail 22 by grasping the outer end 24 of the rail 22. In this instance, the end 24 of the rail 22 abuts the housing 40 in one direction of tilt, FIG. 2, and the crank arm 21 abuts the housing 40 in the other direction of tilt providing stops for the angular motion of the crank arm 21 with the weight of the container at the lower end of the rail 22 holding the position.

Figure 5:
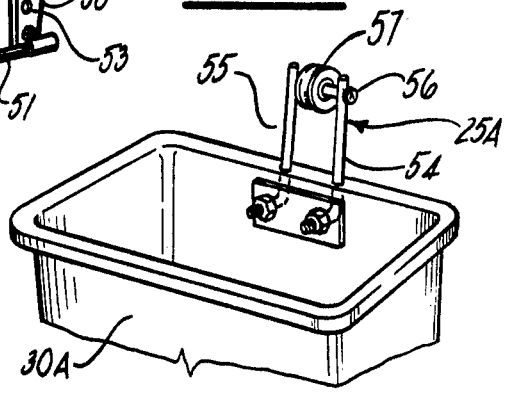
FIG. 5 is a perspective view of a container, partly broken away, illustrating a trolley fixedly mounted on the container.

The container 30A, FIG. 5, has a fixedly attached trolley 25A. The trolley 25A includes two straps 54 and 55 bolted on the container 30A. An axle 56 lies between the outer ends of the straps 54 and 55. A wheel 57 turns on the axle 56. In this modification the trolley 25A is removed and replaced on the rail 22 along with the container 30A.

Figure 4:
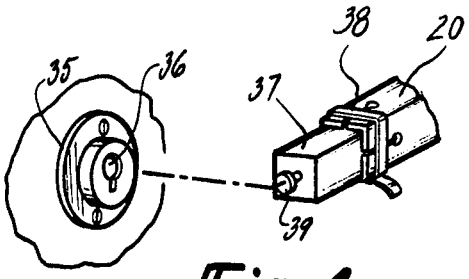
FIG. 4 is an exploded partial view of the pivotal mounting means, partly in cross-section and broken away, illustrating the de-mountable key-hole slot and pin interconnection.
Figure 6:
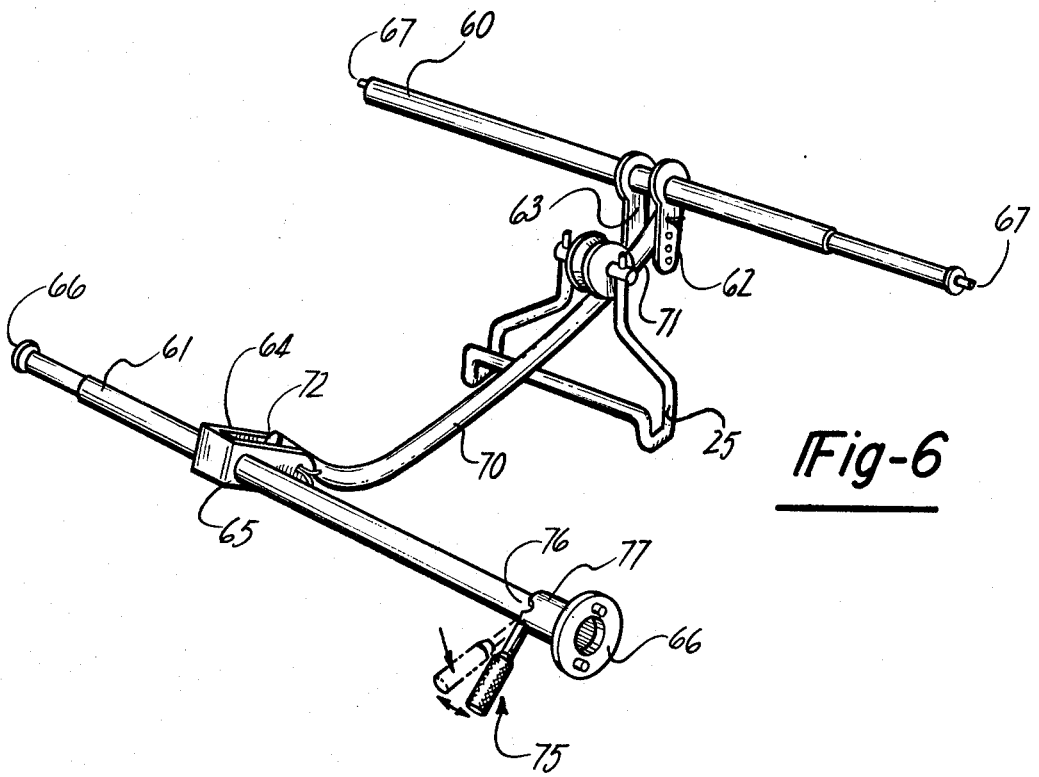
FIG. 6 is a perspective view of the double-hung embodiment of the invention showing two mounting shafts equipped with paired pivotal like-hangers, the rail connected between the hangers on the shafts, a trolley on the rail and an operating lever.
Figure 7:
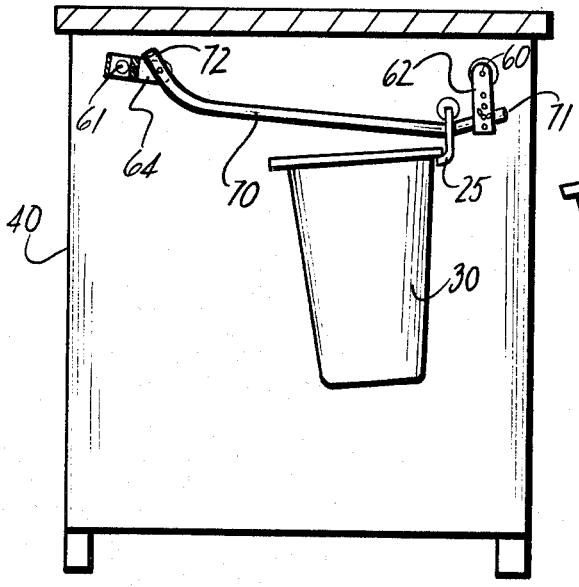
FIG. 7 is a view similar to FIG. 2 showing the double-hung embodiment in the storage position.
Figure 8:
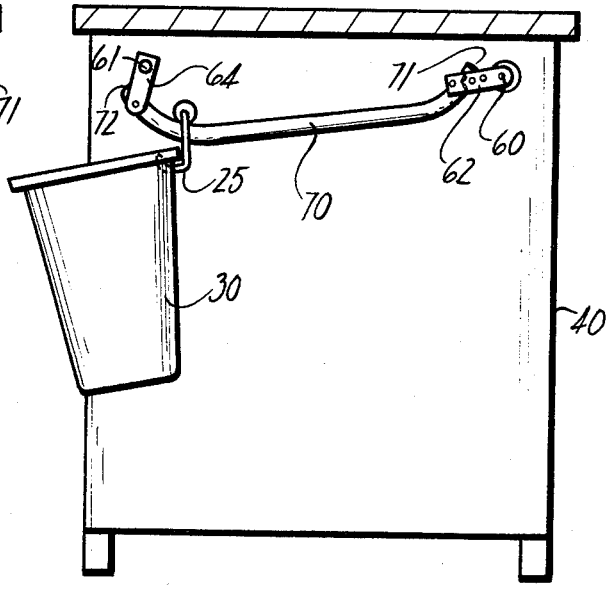
FIG. 8 is a view similar to FIG. 3 showing the double-hung embodiment in the use position.

Referring now to the double-hung embodiment of the invention, FIGS. 6, 7 and 8, an inner shaft 60 is povitally mounted in the back of the housing 40 and an outer shaft 61 is pivotally mounted at the front of the housing 40. Paired hanger links 62 and 63 are supported on the shaft 60 and paired hanger links 64 and 65 are supported on the shaft 61. The rods 60 and 61 are telescopically extendable to fit the housing 40. Discs 66 are mounted on the housing 40 at the ends of the shafts 60 and 61 and have apertures receiving the studs 67 extending from the ends of the shafts 60 and 61. The shafts 60 and 61 may have an internal spring urging them against the discs 66 or a clamp, such as that shown in FIG. 4, holding them in adjusted extension. Obviously the shafts may be non-rotatable and the links pivotally mounted on the shafts.

A rail 70 has an up-turned inner end 71 pivotally hung on the links 62, 63 and an up-turned outer end 73 pivotally hung on the links 64, 65. The trolley 25 rolls on the rail 70. The distance between the shafts 60 and 61 may be considered a fixed distance. The distance between the points on the rail 70 where it is pivotally connected to the links 62, 63 and 64, 65 is less than the fixed distance between the shafts 60, 61. To make up for the difference in these distances, one set of links 64, 65 in FIG. 7 and 62, 63 in FIG. 8 must extend sidewardly elevating that end of the rail 70 when the other sets of links 62, 63 in FIG. 7 and 64, 65 in FIG. 8 extend downwardly to lower the other end of the rail 70. Thus when the outer end 72 of the rail 70 is elevated the inner end 71 is lowered and the trolley 25 rolls into the housing 40 carrying the container 30 into the housing 40, FIG. 7, for storage. Also when the outer end 72 of the rail 70 is lowered the inner end 71 is elevated and the trolley 25 rolls out of the housing 40 carrying the container 30 out of the housing 40, FIG. 8, for use.

An operating lever assembly 75 is attached to the outer shaft 61 to pivot the outer shaft 61. The lever assembly 75 includes ratchet grooves 76 on the hub 77 which lock the assembly 75 in the adjusted position. The handle 78 is spring biased into the grooves 76 and is manually moved against the bias out of the grooves 76 for operation.

It will be noted that the up-turned ends 71 and 72 of the rail 70 decelerate the roll of the trolley toward both ends and that upon change of tilt of the rail 70, the adjacent up-turned end of the rail 70 gives the trolley wheel a "lift" and a "kick" to overcome initial inertia, friction, etc. providing an added impetus on the start of trolley 25 roll to the use and storage positions.

It will also be noted that the double-hung embodiment of FIGS. 6, 7 and 8 has inherent stops at the up-turned ends 71, 72 of the rail 70 and that the trolley rolls to the low point or end of the rail 70 with its weight and the weight of the container and its load holding it in the adjusted position.

The rails 22 and 70 as shown and described preferably have lower center portions and up-turned ends to provide a gradient for acceleration and deceleration. However, the rails may be straight within the concept of the invention. Also the rail 70 may be directly manually actuated between the storage and use positions.

In use and operation, the office worker, workman, mechanic, janitor, etc. simply tilts the rails 22, 70 downwardly-outwardly and the trolley 25, 25A rolls down the rail to the use position. In the case of the janitor, he must remove the container 30 for emptying and replace it. The users then tilt the rails 22, 70 downwardly-inwardly and the trolley rolls down the rails 22, 70 to the storage position.

With the novel container hanger apparatus the container never rests on the floor leaving it clear for cleaning at all times and locates the container in otherwise unused space leaving the normally used space available for other use and clearing it from obstruction, hazard, etc..

While only two preferred embodiments of the invention have been described and illustrated, it will be understood that the patent protection of the invention is limited only by the scope of the appended claims as various modifications and selections may be made without departing from the invention.

I claim:

1. Apparatus for extending a container from a housing for use and for retracting a container into a housing for storage, comprising, a rail having an outer end and an inner end;

a trolley rollable on said rail for carrying a container; and means mountable on a housing tiltably supporting said rail between a first position inclining downwardly-outwardly to roll said trolley to said outer end of said rail to carry a container to a use position outwardly of a housing and a second position inclining downwardly-inwardly to roll said trolley to said inner end of said rail to carry a container to a storage position inwardly of a housing, said means comprising a shaft, means pivotally mounting said shaft, a crank-arm on said shaft, and stop means for limiting crank-arm angular motion between two points.

2. In apparatus as set forth in claim 1, a remote end on said crank-arm extending radially from said shaft in a direction inwardly of a housing;

said inner end of said rail being fixedly connected to said remote end of said crank-arm to swing angularly therewith;

said rail extending from said remote end of said crank-arm past said shaft so that said outer end of said rail is over center and moves angularly in an opposite direction to said crank-arm during pivotal motion of said shaft and said crank-arm to raise said inner end and lower the outer end of said rail to cause said trolley to roll outwardly of a housing and to lower said inner end and raise said outer end of said rail to cause said trolley to roll inwardly of a housing.

3. In apparatus as set forth in claim 1, said means comprising a near pivotally mounted link-hanger and a remote pivotally mounted link-hanger;

said outer end of said rail being pivotally connected to said near link-hanger and said inner end of said rail being pivotally connected to said remote link hanger;

the distance between the points of connection of link-hangers to said rail being less than the distance between the pivotal mountings of said link-hangers themselves so that when one link-hanger extends downwardly to lower one end of said rail, the other link-hanger extends sidewardly to raise the other end of said rail to tilt said rail to cause said trolley to roll with a container into and out of a housing.

4. In apparatus as set forth in claim 2, said rail curving downwardly from its connection to said crank-arm as to lie below the pivotal axis of said shaft and then curving upwardly so as to lie above the pivotal axis of said shaft to provide added downward inclination at said trolley to accelerate it to start its roll when the shaft and crank-arm are actuated to tilt and to provide added upward inclination of said rail to decelerate said trolley to slow its roll when said trolley is reaching the end of its roll.

5. In apparatus as set forth in claim 3, said rail having upwardly curved ends adjacent its connection to said hanger links to provide added downward inclination at said trolley to start its roll when said rail is actuated to tilt and to provide added upward inclination of said rail to decelerate said trolley to slow its roll when said trolley is reaching the end of its roll.

* * * * *